US005227714A

United States Patent [19]

Lou

[11] Patent Number: 5,227,714

[45] Date of Patent: Jul. 13, 1993

[54] VOLTAGE REGULATOR

[75] Inventor: Perry W. Lou, Carlsbad, Calif.

[73] Assignee: Brooktree Corporation, San Diego, Calif.

[21] Appl. No.: 772,218

[22] Filed: Oct. 7, 1991

[51] Int. Cl.[5] ..... G05F 1/56

[52] U.S. Cl. ..... 323/282; 323/315

[58] Field of Search ..... 323/280–282, 323/315, 316, 349, 351, 312–314

[56] References Cited

U.S. PATENT DOCUMENTS 4,641,081 2/1987 Sato et al. ..... 323/313

4,779,037 10/1988 LoCascio ..... 323/281

*Primary Examiner*—Emanuel T. Voeltz

*Attorney, Agent, or Firm*—Ellsworth R. Roston; Charles H. Schwartz

[57] ABSTRACT

A system for regulating an output voltage to a particular value includes a control transistor which produces an output voltage when energized by an energizing voltage. A voltage divider formed as by a pair of transistors with a particular ratio of transconductances divides the magnitude of this output voltage by a ratio related to the ratio of the transconductances. The transistors in the voltage divider may be respectively CMOS n- and p- transistors. The divided output voltage is introduced to a comparator (formed as from a pair of transistors) for comparison with a fixed reference voltage obtained as from a resistance ladder energized by the energizing voltage. The comparator introduces voltages to a comparator amplifier in accordance with such comparison. The comparator amplifier may include a transistor which produces changes in a current related to changes in the divided output voltage. The comparator amplifier may further include a current mirror which provides changes in a current related to changes in the current through the amplifier transistor. The current changes in the current mirror cause changes to be produced in a voltage (e.g. error voltage) from the current mirror. These error voltage changes are introduced to the control transistor to regulate the output voltage to the particular value.

20 Claims, 2 Drawing Sheets $V_{CC}$
FOLDED-CASCODE GAIN STAGE
BIAS GENERATOR AND COMPARATOR
REFERENCE DIVIDER
10
12
14
$V_{DD}$
22
24
34
36
50
52
54
56
58
60
62
64
66

VOLTAGE REGULATOR

This invention relates to a voltage regulator. More particularly, the invention relates to a system for regulating an output voltage to a particular value.

Variable delay lines are provided for a number of different purposes. One purpose is to test the operation of semiconductor chips in different operating equipment. The operation of these semiconductor chips is tested by measuring delays in signal transitions at strategic terminals in these chips. These delays are measured at a particular voltage point in the signal transitions. For CMOS circuits, this particular voltage may be 1.5 volts.

The particular transition voltage such as +1.5 volts is important. This voltage constitutes substantially the midpoint of the signal transitions. If the transition voltage varies from the particular value, the symmetry of the transitions in the rising and falling edges of the signal being tested is disturbed. In other words, one of the rising and falling transitions will occur above the midpoint of the transitions and the other one of the rising and falling transitions will occur below the mid point of the transitions. This tends to invalidate or at least impair the tests being made on the signal transitions in the integrated circuit chip being tested.

In CMOS circuits, an optimal interface has to be provided to the minimum TTL input specifications. The energizing voltage VCC for CMOS circuits is generally +5 volts. A voltage $V_{DD}$ is generated from the energizing voltage $V_{cc}$ for use for input, output and delay processing logic. The voltage $V_{DD}$ is generally at +3 volts. A voltage, generally at +1.5 volts, is provided to serve as the mid point for the signal transitions. It has not been easy to generate these voltages reliably to meet TTL input signal specifications although significant amounts of money have been expended, and considerable effort has been devoted, to provide CMOS circuitry which meets such specifications.

In one embodiment of the invention, a system for regulating an output voltage to a particular value includes a control transistor which produces an output voltage when energized by an energizing voltage. A voltage divider formed as by a pair of transistors with a particular ratio of transconductances divides the magnitude of this output voltage by a ratio related to the ratio of the transconductances. The transistors in the voltage divider may be respectively CMOS n- and p- transistors. The divided output voltage is introduced to a comparator (formed as from a pair of transistors) for comparison with a fixed reference voltage obtained as from a resistance ladder energized by the energizing voltage. The comparator introduces voltages to a comparator amplifier in accordance with such comparison. The comparator amplifier may include a transistor which produces changes in a current related to changes in the divided output voltage. The comparator amplifier may further include a current mirror which provides changes in a current related to changes in the current through the amplifier transistor. The current changes in the current mirror cause changes to be produced in a voltage (e.g. error voltage) from the current mirror. These error voltage changes are introduced to the control transistor to regulate the output voltage to the particular value.

Figure 1:
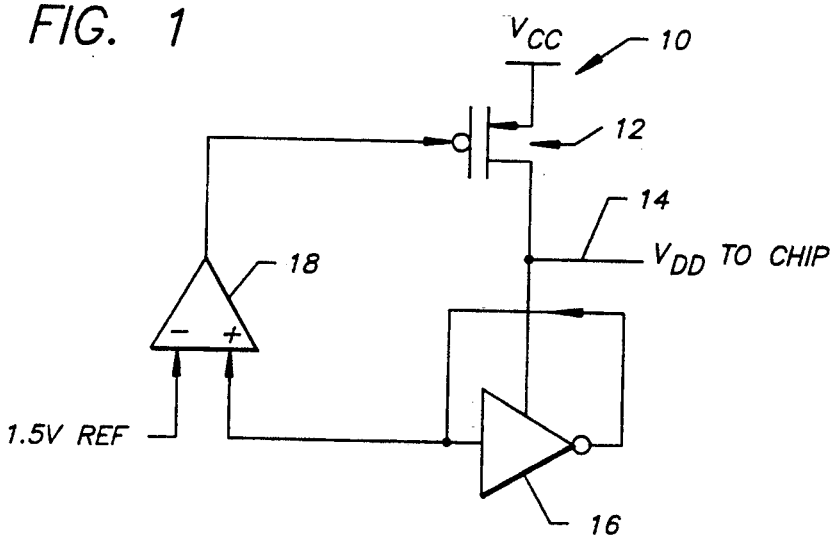
FIG. 1 is a circuit diagram, almost entirely in block form, of one embodiment of the invention.

In the block diagram shown in FIG. 1, a voltage $V_{CC}$ is provided at 10. The voltage $V_{CC}$ may be +5 volts and may be introduced to the source of a pass or control transistor 12 which may be a CMOS transistor of the p-type. The voltage on the drain of the transistor 12 may be designated as a supply or output voltage and is introduced to a line 14 and to an amplifier-inverter 16 to energize the amplifier-inverter. The output of the amplifier-inverter 16 may be introduced to the input of the amplifier-inverter and to an input terminal of a comparator/amplifier 18, a second input terminal of which receives a reference voltage such as +1.5 volts. The output of the comparator/amplifier 18 passes to the gate of the control transistor 12.

The energizing voltage 10 causes current to pass through the control transistor 12 so that a voltage approximating +3 volts is introduced to the line 14. The amplifier/inverter 16 is constructed to divide the voltage by two (2) so that a voltage of +1.5 volts is introduced to the comparator/amplifier 18 for comparison with the reference voltage of +1.5 volts. Any difference or error voltage from the comparator/amplifier 18 is introduced to the gate of the control transistor 12 to regulate the current through the transistor 10 as to provide for the production of a regulated output voltage of +3 volts at the drain of the transistor.

Figure 2:
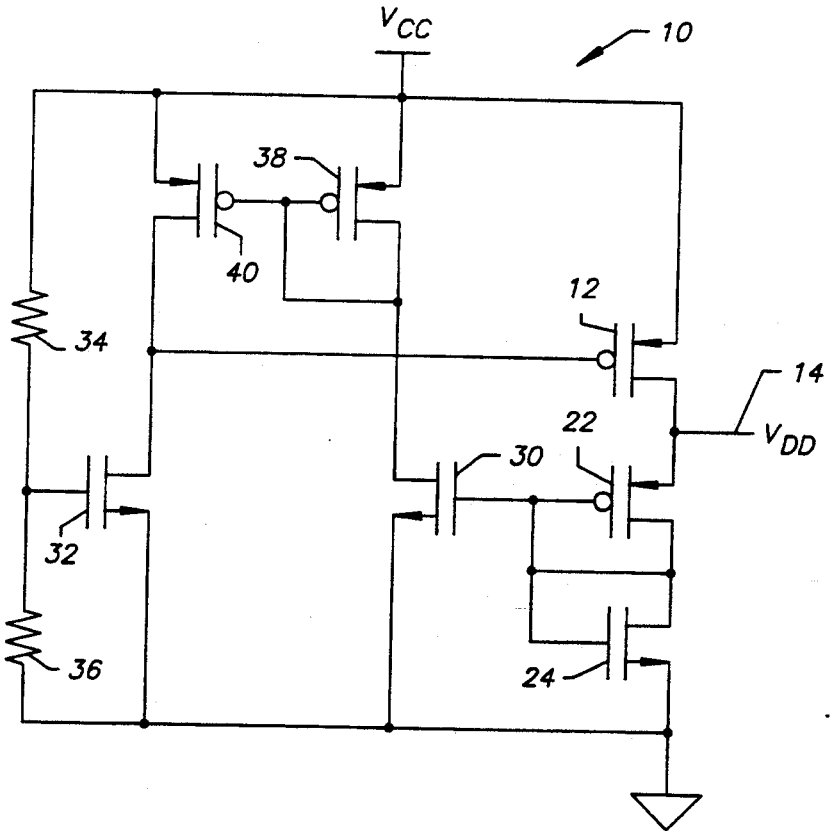
FIG. 2 is a somewhat detailed circuit diagram of the embodiment of the invention shown in FIG. 1.

FIG. 2 illustrates in some detail the embodiment of the invention shown in FIG. 1 and described above. The embodiment of the invention shown in FIG. 2 includes the line 10 for providing the energizing voltage $V_{CC}$, the control transistor 12 and the supply or output line 14 for providing the voltage $V_{DD}$. The drain of the transistor 12 is connected to the source of a transistor 22 which may be a CMOS transistor of the p- type. The drain and the gate of the transistor 22 have a common connection with the drain of a transistor 24 which may be a CMOS transistor of the n- type. The source of the transistor 24 may be at a suitable reference potential such as ground. The transistors 22 and 24 preferably have substantially equal transconductances.

A connection is made from the drains of the transistors 22 and 24 to the gate of a transistor 30 which may also be a CMOS transistor of the n- type. The sources of the transistor 30 and of a transistor 32 may be at the reference potential such as ground. The transistor 32 may be a CMOS transistor of the n- type and may form a comparator with the transistor 30. The transistors 30 and 32 preferably have substantially equal characteristics. The gate of the transistor 32 receives a reference potential such as +1.5 volts from the common terminal between a pair of resistances 34 and 36. The resistances 34 and 36 are in series between the line 10 and the reference potential such as ground and define a resistance ladder network.

The drains of the transistors 30 and 32 are respectively common with the drains of a pair of transistors 38 and 40 both of which are CMOS transistors of the p-type. The transistors 38 and 40 are included in a comparator/amplifier. The transistors 38 and 40 preferably have substantially equal characteristics. The sources of the transistors 38 and 40 receive the voltage $V_{CC}$ on the line 10. The drain and the gate of the transistor 38 and the gate of the transistor 40 are common. The voltage on the drain of the transistor 40 is introduced to the gate of the transistor 12.

As previously described, the voltage on the line 14 is approximately +3 volts. This voltage is divided by the transistors 22 and 24 so that the voltage on the drain of the transistors 22 and 24 is approximately +1.5 volts. This voltage is introduced to the transistor 30 for comparison with the reference voltage on the gate of the transistor 32.

Assume that the voltage introduced to the gate of the transistor 30 from the drains of the transistors 22 and 24 is less than the reference voltage of +1.5 volts on the gate of the transistor 32. This causes the current through the transistor 30 to be less than the current through the transistor 32. Because of this, the voltage on the drains of the transistors 30 and 38 is greater than the voltage on the drains of the transistor 32 and 40.

The transistor 30 effectively serves as a resistor. Therefore, because of the increased voltage on the drain of the transistor 38, the current through the transistor 38 decreases, thereby producing an increased voltage on the drain of the transformer 38 and the gate of the transistor 40. The current through the transistor 40 decreases as a result of the increased voltage on the gate of the transistor. This causes the voltage on the drain of the transistor 40 to decrease. When introduced to the gate of the transistor 12, this voltage causes the current through the transistor 12 to increase, thereby increasing the voltage on the drain of the transistor. In this way, the voltage on the line 14 is regulated at +3 volts and the voltage on the drains of the transistors 22 and 24 is regulated at +1.5 volts.

Figure 3:
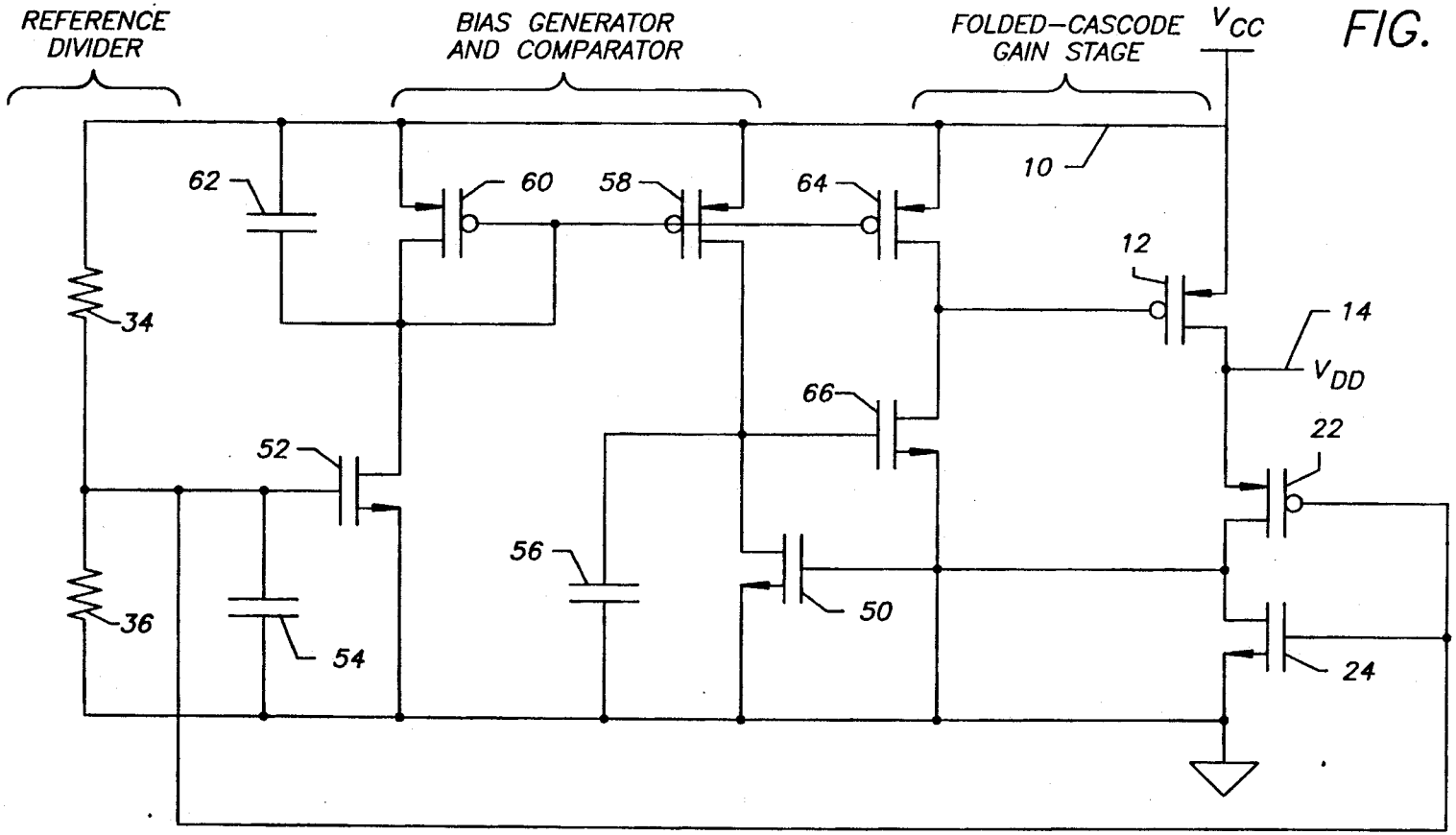
FIG. 3 is a somewhat detailed circuit diagram of another embodiment of the invention.

FIG. 3 illustrates another embodiment of the invention. In this embodiment, the line 10, the transistor 12, the line 14 and the transistors 22 and 24 are provided in the same manner as in the embodiment shown in FIG. 2 and described above. However, the gates of the transistors 22 and 24 are connected to the terminal common to the resistances 34 and 36. The resistance ladder 34 and 36 is also provided in the embodiment shown in FIG. 3 in the same manner as in the embodiment shown in FIG. 2.

In the embodiment shown in FIG. 3, the voltage on the drains of the transistors 22 and 24 and the voltage on the terminal common to the resistances 34 and 36 are respectively introduced to the gates of transistors 50 and 52 in the same manner as in the embodiment shown in FIG. 2. The transistors 50 and 52 may be CMOS transistors of the n- type and preferably have substantially equal characteristics. The sources of the transistors are at the reference potential such as ground. A capacitor 54 is connected between the gate and source of the transistor 52 to pass noise on the gate of the transistor 52 to ground.

A capacitor 56 is connected between the drain of the transistor 50 and ground to pass any noise on the drain of the transistor to ground. Connections are respectively made from the drains of the transistors 50 and 52 to the drains of transistors 58 and 60, each of which may be a CMOS transistor of the p- type. The transistors 58 and 60 preferably have substantially equal characteristics. The sources of the transistors 58 and 60 receive the energizing voltage $V_{CC}$ on the line 10. The gates of the transistors 58 and 60 are common with the drain of the transistor 60. A capacitor 62 is connected between the drain of the transistor 60 and the line 10 to eliminate any noise on the drain of the transistor 60.

The source of a transistor 64 receives the energizing voltage on the line 10. The transistor 64 may be a CMOS transistor of the p- type. Connections are made from the drain of the transistor 64 to the gate of the control transistor 12 and to the drain of a transistor 66, which may be a CMOS transistor of the n- type. The gate of the transistor 66 is common with the drain of the transistor 50. The drain of the transistor 66 receives the voltage on the drains of the transistors 22 and 24.

Assume that the voltage on the drains of the transistors 22 and 24 is less than 1.5 volts. This causes the current through the transistor 52 to be greater than the current through the transistor 50 and the voltage on the drain of the transistor 52 to be lower than the voltage on the drain of the transistor 50. The reduced voltage on the drain of the transistor 52 causes the current through the transistor 60 to increase since the transistor effectively acts as a resistance. This assures that the voltage on the drain of the transistor 60 will be reduced.

The reduced voltage on the drain of the transistor 60 is introduced to the gate of the transistor 58 to produce an increased current through the transistor 58 and a decreased voltage drop across the transistor. The resultant increase in the voltage on the drain of the transistor 58 produces an increase in the current through the transistor 66 and accordingly a decrease in the voltage across the transistor. This causes the voltage introduced to the gate of the transistor 12 to decrease and the current through the transducer to increase, thereby producing an increase in the voltage on the line 14.

The increase in the voltage on the line 14 is amplified by the transistors 22 and 24 because of the separate connections to the gate and drain of each transistor. In this way, the voltage on the line 14 is regulated to provide a voltage of +3 volts. This regulation is even more sensitive than that provided by the embodiment shown in FIG. 2 because of the operation of the transistors 22 and 24 in FIG. 3 as amplifiers, because of the inclusion of the transistors 64 and 66 in a folded-cascode gain stage and because of the inclusion of the capacitors 52, 56 and 62.

The circuitry described above has certain important advantages. It provides a sensitive regulation of the voltage $V_{DD}$ to maintain the voltage at +3 volts. It also provides a sensitive regulation of a voltage of +1.5 volts to provide a stable transition point for measuring signal amplitudes to determine the symmetry of rising and falling edges in such signals.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination for providing an output voltage having a regulated value, means for providing an energizing voltage, control means responsive to the energizing voltage for producing a flow of current through the control means to obtain an output voltage, a pair of current means connected in a circuit with the control means for producing a first voltage constituting a particular fraction of the output voltage, means for providing a comparison voltage, means including a current mirror responsive to the relative values of the comparison voltage and the first voltage for introducing an error voltage to the control means to vary the current through the control means in a direction for producing the regulated value of the output voltage.

2. In a combination as set forth in claim 1, the pair of current means constituting a pair of transistors having transconductances in a particular relationship dependent upon the relative values of the output voltage and the first voltage, the pair of current means being connected to provide an amplification of any changes in the output voltage from the regulated value.

3. In a combination as set forth in claim 2, the pair of current means constitute a p- transistor and an n- transistor in series with the control means and the energizing voltage means and having substantially equal transductances.

4. In a combination as set forth in claim 2, the error voltage means including a comparator for comparing the comparison voltage and the first voltage for producing an output representative of any difference between the comparison voltage and the first voltage and further including the current mirror responsive to such difference for producing the error voltage for introduction to the control means.

5. In combination for providing an output voltage having a regulated value, a transistor having a source, a gate and a drain, first means for introducing an energizing voltage to the source of the transistor to obtain a flow of current through the transistor and a voltage on the drain of the transistor in accordance with such current flow, second means for producing a particular reduction in the voltage on the drain of the transistor, means for providing a comparison voltage, third means including a current mirror responsive to the reduced voltage and to the comparison voltage for producing an error voltage in accordance with the relative values of the reduced voltage and the comparison voltage, and fourth means responsive to the error voltage for introducing the error voltage to the gate of the transistor to regulate the current through the transistor for the production of the regulated voltage on the drain of the transistor.

6. In a combination as set forth in claim 5 wherein the fourth means include a comparative amplifier responsive to the error voltage from the third means for amplifying the error voltage and for introducing the amplified error voltage to the gate of the transistor to regulate the current through the transistor for the production of the regulated voltage on the drain of the transistor.

7. In a combination as set forth in claims 5 or 6 wherein the second means include a pair of transistors having particular transconductances relative to each other to obtain the particular reduction in the voltage on the drain of the transistor, the pair of transistors being connected to provide an amplification of any changes in the output voltage from the regulated value.

8. In combination for providing an output voltage having a regulated value, a transistor having a source, a gate and a drain, first means for introducing an energizing voltage to the source of the transistor to obtain a flow of current through the transistor and a voltage on the drain of the transistor in accordance with such current flow, second means for producing a particular reduction in the voltage on the drain of the transistor, means for providing a comparison voltage, third means responsive to the reduced voltage and to the comparison voltage for producing an error voltage in accordance with the relative values of the reduced voltage and the comparison voltage, and fourth means responsive to the error voltage for introducing the error voltage to the gate of the transistor to regulate the current through the transistor for the production of the regulated voltage on the drain of the transistor.

the transistor constituting a first transistor, the fourth third means including a second transistor responsive to the reduced voltage for producing a voltage dependent upon the reduced voltage and including a third transistor responsive to the voltage from the second transistor and to the comparison voltage for producing the error voltage for introduction to the gate of the first transistor to regulate the current through the first transistor for the production of the regulated voltage on the drain of the first transistor.

9. In combination for providing an output voltage having a regulated value, means for providing an energizing voltage, first semiconductor means responsive to the energizing voltage for passing a variable current and for producing an output voltage dependent upon the variations in the current, second semiconductor means responsive to the output voltage for producing a first particular fraction of the output voltage, third semiconductor means responsive to the energizing voltage for producing a second particular fraction of the energizing voltage, fourth semiconductor means responsive to the first particular fraction of the output voltage and the second particular fraction of the energizing voltage for producing an error voltage, and fifth means including a current mirror responsive to the error voltage for introducing a voltage related to the error voltage to the first semiconductor means to vary the current through the first semiconductor means in a direction for maintaining the output voltage at the regulated value.

10. In a combination as set forth in claim 9, the first semi-conductor means including a CMOS transistor of the p-type and the second semi-conductor means including a pair of CMOS transistors connected in series with the CMOS transistor of the p-type and having relative transconductances to produce the particular fraction of the output voltage.

11. In a combination as set forth in claim 10, the pair of CMOS transistors constituting an n- transistor and a p- transistor in series.

12. In combination for providing an output voltage having a regulated value, first means for providing an energizing voltage, control means responsive to the energizing voltage for producing a flow of current through the control means and an output voltage dependent upon such current flow, second means for obtaining a first particular fraction of the output voltage from the control means, third means for providing a second particular fraction of the energizing voltage, comparator means responsive to any difference between the first particular fraction of the output voltage from the control means and the second particular fraction of the energizing voltage for producing a voltage representative of such difference, fourth means responsive to the voltage from the comparator means for producing a current dependent upon the magnitude of such voltage, and a current mirror responsive to the current through the fourth means for producing an error voltage for introduction to the control means for regulating the current through the control means to obtain the regulated value for the output voltage.

13. In a combination as set forth in claim 12, the second means including a pair of transistors having relative values of transconductance dependent upon the particular fraction of the output voltage.

14. In a combination as set forth in claim 13, the transistors in the second means being connected to provide an amplification of any changes in the output voltage to enhance the sensitivity in the regulation of the output voltage.

15. In a combination as set forth in any of claim 11;

amplifier means responsive to the error voltage for amplifying the error voltage for introduction to the control means to regulate the output voltage at the regulated value.

16. In a combination as set forth in claim 15, the amplifier means being included in a folded-cascode gain stage.

17. In a combination as set forth in claim 9, the fourth semiconductor means including a first transistor responsive to a particular one of the first particular fraction of the output voltage and the second particular fraction of the energizing voltage for producing a resultant voltage and the current mirror including a second transistor responsive to the resultant voltage and the other one of the first particular fraction of the output voltage and the second particular fraction of the energizing voltage for producing the error voltage for introduction to the first semiconductor means to vary the current through the first semiconductor means in a direction for maintaining the output voltage at the regulated value.

18. In a combination as set forth in claim 1, the error voltage means including means responsive to a particular one of the first voltage and the comparison voltage for producing a resultant voltage dependent upon such particular one of such voltages and including means responsive to the resultant voltage and the other one of the first voltage and the comparison voltage for producing the error voltage for introduction to the control means to vary the current through the control means in a direction for producing the regulated value of the output voltage.

19. In a combination as set forth in claim 2, the error voltage means including means responsive to a particular one of the first voltage and the comparison voltage for producing a resultant voltage dependent upon such particular one of such voltages and including means responsive to the resultant voltage and the other one of the first voltage and the comparison voltage for producing a current and including means responsive to the current for producing the error voltage for introduction to the control means to vary the current through the control means in a direction for producing the regulated value of the output voltage.

20. In a combination as set forth in claim 6, the transistor constituting a first transistor, the third means including a second transistor for producing a resultant voltage dependent upon a particular one of the comparison voltage and the particular reduction in the voltage on the drain of the first transistor and including a third transistor responsive to the resultant voltage and the other one of the comparison voltage and the particular reduction in the voltage o the drain of the first transistor for providing a current through the third transistor and for producing the error voltage in accordance with such current.

* * * * *